US011725455B2

(12) United States Patent
Menendez

(10) Patent No.: US 11,725,455 B2
(45) **Date of Patent: *Aug. 15, 2023**

(54) ROLLER SHADE HEM BAR ASSEMBLY

(71) Applicant: Crestron Electronics, Inc., Rockleigh, NJ (US)

(72) Inventor: Victor M. Menendez, Carrollton, TX (US)

(73) Assignee: Crestron Electronics, Inc., Rockleigh, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/962,676

(22) Filed: Oct. 10, 2022

(65) Prior Publication Data

US 2023/0031632 A1 Feb. 2, 2023

Related U.S. Application Data

(63) Continuation of application No. 17/347,856, filed on Jun. 15, 2021, now Pat. No. 11,499,368.

(51) Int. Cl.
*E06B 9/42* (2006.01)

(52) U.S. Cl.
CPC ..... *E06B 9/42* (2013.01)

(58) Field of Classification Search
CPC ..... E06B 9/42
See application file for complete search history.

(56) References Cited

U.S. PATENT DOCUMENTS

| | | | | | |
|---|---|---|---|---|---|
| 1,233,314 | A | | 7/1917 | Costello | |
| 1,780,556 | A | | 3/1929 | Kallin et al. | |
| 1,782,905 | A | | 12/1929 | Mohun et al. | |
| 1,749,223 | A | | 3/1930 | Mott | |
| 1,909,109 | A | * | 5/1933 | Kopfstein | E06B 9/42 160/394 |
| 2,466,648 | A | | 7/1944 | Thexton | |
| 3,524,491 | A | | 8/1970 | Olson | |
| 4,333,284 | A | * | 6/1982 | Meadows | E06B 3/285 160/368.1 |
| 4,393,915 | A | * | 7/1983 | Olson | A47H 23/01 160/395 |
| 4,610,292 | A | | 9/1986 | Hausmann et al. | |
| 5,671,795 | A | * | 9/1997 | Keil | E06B 9/46 160/384 |
| 5,819,836 | A | * | 10/1998 | Keil | E06B 9/46 160/384 |

(Continued)

*Primary Examiner* — Beth A Stephan
(74) *Attorney, Agent, or Firm* — Crestron Electronics, Inc.

(57) ABSTRACT

A hem bar assembly adapted to secure to a shade material of a roller shade that selectively covers or uncover an architectural opening. The hem bar assembly comprises a first hem bar portion adapted to attach to a second hem bar portion. The first hem bar portion comprises a longitudinal flexible locking member recessed in the inner wall of the first hem bar portion and comprising a channel longitudinally extending therein. The hem bar assembly further comprises a longitudinal spline comprising a longitudinal male plug adapted to wedge and retain the shade material within the locking member channel of the first hem bar portion. The hem bar assembly is configured to attach to the shade material without welding and in exposed, half-wrap, or full-wrap configurations.

19 Claims, 11 Drawing Sheets

(56) References Cited

U.S. PATENT DOCUMENTS

| | | | | |
|---|---|---|---|---|
| 8,028,381 | B2 * | 10/2011 | Murray | E04H 15/646 160/403 |
| D843,131 | S | 3/2019 | Chou | |
| D858,139 | S | 3/2019 | Holt et al. | |
| 10,577,860 | B2 * | 3/2020 | Seuberling | E06B 9/52 |
| 11,215,008 | B2 * | 1/2022 | Blair | E06B 9/388 |
| 2008/0000056 | A1 | 1/2008 | Murray | |
| 2015/0292261 | A1 | 10/2015 | Chou | |
| 2020/0355026 | A1 * | 11/2020 | Liu | E06B 9/46 |
| 2021/0002958 | A1 | 1/2021 | Meyerink et al. | |

* cited by examiner

ROLLER SHADE HEM BAR ASSEMBLY

BACKGROUND OF THE INVENTION

Technical Field

Aspects of the embodiments relate to shades, and more particularly to systems, methods, and modes for a roller shade hem bar assembly that attaches to the shade material of the roller shade without welding.

Background Art

Roller shades are effective in screening windows, doors, or the like, to achieve privacy and thermal effects. A roller shade typically includes a rectangular shade material, such as fabric, attached at its top end to a cylindrical rotating tube, called a roller tube, and at an opposite bottom end to a hem bar. The shade material is wrapped around the roller tube. The roller tube is rotated, either manually or via an electric motor, in a first direction to roll down the shade material to cover a window and in a second direction to roll up the shade material to uncover the window. The hem bar provides weight to the free hanging end of the shade material enabling it to move smoothly as the roller tube rotates.

Hem bar designs come in various styles to achieve different effects. Shade material may be attached to an exposed hem bar that may be available in various color options to add a decorative hardware element to the bottom of the shade. Alternatively, the shade material may be partially or fully wrapped about the hem bar so that the hem bar finish matches the shade material. Often, different types of hem bars are required to achieve each different hem bar style.

In addition, welding is typically requires to attach the shade material to the hem bar. In a pocketed construction, a pocket is formed by the terminal end of the shade material by folding the shade material and welding it onto itself. A metal rod is then inserted into the pocket to provide weight. In other designs, the free handing end of the shade material is welded or fused to a longitudinal spline. A extruded hem bar is provided which in turn contains a longitudinal opening containing a spline receiving channel within the hem bar. The spline with the fused shade material is inserted through a side end of the hem bar into the channel and longitudinally slid through the hem bar until the hem bar is centered with the shade material. Welding, however, may cause the material to appear wavy or puckered, or it may shrink the material. Additionally, welding does not work for shade material that do not weld well, resulting in the appearance of puckering. Also, there are several fabrics that do not have good weld strength, which include materials with multi-ply and delaminate, causing welding to come apart. Welding also makes it difficult to replace a damaged hem bar or shade material.

Other solutions exist that circumvent welding by folding the shade material and inserting the folded end of the shade material through the longitudinal opening in the hem bar and into the longitudinal channel such that a pocket is formed within the longitudinal channel. A metal rod or spline is then inserted through the end of the hem bar and into the shade material pocket. Such process may, however, be complicated as it requires to fish the rod or spline through the shade material pocket, particularly when dealing with textured fabrics that may catch on the rod or spline that is being inserted. This may further cause the shade material to pucker and may damage the shade when trying to slide in a rod of a substantial length.

Accordingly, a need has arisen for a hem bar assembly that simplifies the process of securing the hem bar to the shade material without causing damage to the shade material and which can achieve different hem bar styles.

SUMMARY OF THE INVENTION

It is therefore an object of the embodiments to substantially solve at least the problems and/or disadvantages discussed above, and to provide at least one or more of the advantages described below.

It is a general aspect of the embodiments to provide systems, methods, and modes for a hem bar assembly that simplifies the process of securing the hem bar to the shade material without causing damage to the shade material and which can achieve different hem bar styles.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to one aspect of the embodiments, a hem bar assembly is adapted to secure to a shade material of a roller shade that selectively covers or uncovers an architectural opening. The hem bar assembly comprises a first hem bar portion and a second hem bar portion. The first hem bar portion comprises at least one outer wall, an inner wall, and a first longitudinal flexible locking member recessed in the inner wall of the first hem bar portion and comprising a channel longitudinally extending therein. The second hem bar portion comprises at least one outer wall, an inner wall, and a first longitudinal spline laterally and outwardly extending from the inner wall of the second hem bar portion and terminating with a longitudinal male plug. The male plug of the first spline is adapted to be force fitted and thereby retained within the channel of the first locking member to attach the first hem bar portion to the second hem bar portion. The shade material is adapted to be retained between the first hem bar portion and the second hem bar portion.

According to an embodiment, the first locking member comprises a plurality of integral flexible flanges inwardly extending within the channel of the first locking member to lock the male plug of the first spline therein. According to an embodiment, the at least one of the outer walls of the first hem bar assembly and the second hem bar assembly comprises a straight wall, a curved wall, or any combinations thereof.

According to an embodiment, the shade material is adapted to be wedged and retained within the channel of the first locking member by the first spline. According to an embodiment, when the shade material is attached to the hem bar assembly, the outer walls of the first and second hem bar portions remain exposed. According to another embodiment, the hem bar assembly further comprises a second longitudinal flexible locking member recessed in the inner wall of the first hem bar portion and comprising a channel longitudinally extending therein, and a second longitudinal spline comprising a longitudinal flat body and a longitudinal male plug laterally extending from the longitudinal flat body, wherein the male plug of the second spline is adapted to be force fitted and thereby retained within the channel of the second locking member in the first hem bar portion. According to an embodiment, the second locking member comprises a plurality of integral flexible flanges inwardly extending within the channel of the second locking member to lock the male plug of the second spline therein. According to an embodiment, the shade material is adapted to be wedged and retained within the channel of the second locking member by the second spline. According to an embodiment, wherein the shade material is further adapted to be wedged and retained within the channel of the first locking member by the first spline. According to one embodiment, when the shade material is attached to the hem bar assembly, the outer walls of the first and second hem bar portions remain exposed. According to another embodiment, the shade material is adapted to be wrapped over the at least one outer wall of the first hem bar portion.

According to another embodiment, the hem bar assembly further comprises a third longitudinal flexible locking member recessed in the inner wall of the second hem bar portion and comprising a channel longitudinally extending therein, and a third longitudinal spline comprising a longitudinal flat body and a longitudinal male plug laterally extending from the longitudinal flat body of the third spline, wherein the male plug of the third spline is adapted to be force fitted and thereby retained within the channel of the third locking member in the second hem bar portion. According to an embodiment, the third locking member comprises a plurality of integral flexible flanges inwardly extending within the channel of the third locking member to lock the male plug of the third spline therein. According to an embodiment, the shade material is adapted to be wedged and retained within the channel of the third locking member by the third spline. According to an embodiment, the shade material is adapted to be wrapped over the outer walls of the first and second hem bar portions.

According to another embodiment, the first and second hem bar portions further comprise a pair of magnets recessed in their respective inner surfaces, wherein the pair of magnets provide additional retention between the first and second hem bar portions. According to another embodiment, at least one of the first and second hem bar portions comprises a bore longitudinally extending therethrough adapted to receive weighted material therein. According to a further embodiment, the first hem bar portion is attached to the second hem bar portion via a hinge. According to yet another embodiment, each of the first hem bar portion and the second hem bar portion comprises at least one bore extending through terminal ends thereof, wherein the hem bar assembly further comprises a pair of end caps each comprising at least two projections adapted to fit within the bores in the first and second hem bar portions. According to an embodiment, the first hem bar portion comprises a longitudinal channel adapted to retain the first locking member therein, and wherein the first hem bar portion is made from a different material than the first locking member.

According to an alternative embodiment, the hem bar assembly further comprises a second longitudinal flexible locking member recessed in the inner wall of the second hem bar portion and comprising a channel longitudinally extending therein, and a second longitudinal spline comprising a longitudinal flat body and a longitudinal male plug laterally extending from the longitudinal flat body, wherein the male plug of the second spline is adapted to be force fitted and thereby retained within the channel of the second locking member in the second hem bar portion. According to an embodiment, the second locking member comprises a plurality of integral flexible flanges inwardly extending within the channel of the second locking member to lock the male plug of the second spline therein. According to an embodiment, the shade material is adapted to be wedged and retained within the channel of the second locking member by the second spline.

According to another aspects of the embodiments, a hem bar assembly is adapted to secure to a shade material of a roller shade that selectively covers or uncovers an architectural opening. The hem bar assembly comprises a first hem bar portion comprising at least one outer wall, an inner wall, and a longitudinal flexible locking member recessed in the inner wall of the first hem bar portion and comprising a channel longitudinally extending therein. The hem bar assembly further comprises a second hem bar portion comprising at least one outer wall and an inner wall, and a longitudinal spline comprising a longitudinal male plug. Wherein the first hem bar portion is adapted to attach to the second hem bar portion, and wherein the shade material is adapted to be retained between the first hem bar portion and the second hem bar portion by being wedged and retained within the channel of the locking member by the spline.

According to a further aspects of the embodiments, a hem bar assembly is adapted to secure to a shade material of a roller shade that selectively covers or uncovers an architectural opening. The hem bar assembly comprises a first hem bar portion and a second hem bar portion. The first hem bar portion comprises at least one outer wall, an inner wall, a first longitudinal flexible locking member and a second longitudinal flexible locking member recessed in the inner wall of the first hem bar portion and each comprising a channel longitudinally extending therein. The second hem bar portion comprises at least one outer wall, an inner wall, and a first longitudinal spline laterally and outwardly extending from the inner wall of the second hem bar portion and terminating with a longitudinal male plug. The hem bar assembly further comprises a second longitudinal spline comprising a longitudinal flat body and a longitudinal male plug laterally extending from the longitudinal flat body. The male plug of the first spline is adapted to be force fitted and thereby retained within the channel of the first locking member to attach the first hem bar portion to the second hem bar portion. The hem bar assembly is adapted to be attached to the shade material in an exposed hem bar configuration whereby the shade material is wedged and retained within the channel of the first locking member by the first spline. The hem bar assembly is adapted to be attached to the shade material in a half-wrap hem bar configuration whereby the shade material is wedged and retained within the channel of the second locking member by the second spline, wrapped about the at least one outer wall of the first hem bar portion, and wedged and retained within the channel of the first locking member by the first spline.

According to yet another aspects of the embodiments, a hem bar assembly is adapted to secure to a shade material of a roller shade that selectively covers or uncovers an architectural opening. The hem bar assembly comprises a first hem bar portion and a second hem bar portion. The first hem bar portion comprises at least one outer wall, an inner wall, a first longitudinal flexible locking member and a second longitudinal flexible locking member recessed in the inner wall of the first hem bar portion and each comprising a channel longitudinally extending therein. The second hem bar portion comprise at least one outer wall, an inner wall, a third longitudinal flexible locking member recessed in the inner wall of the second hem bar portion and comprising a channel longitudinally extending therein, and a first longitudinal spline laterally and outwardly extending from the inner wall of the second hem bar portion and terminating with a longitudinal male plug. The hem bar assembly also comprises a second longitudinal spline and a third longitudinal spline each comprising a longitudinal flat body and a longitudinal male plug laterally extending from the longitudinal flat body. The male plug of the first spline is adapted to be force fitted and thereby retained within the channel of the first locking member to attach the first hem bar portion to the second hem bar portion. The hem bar assembly is adapted to be attached to the shade material in an exposed hem bar configuration whereby the shade material is wedged and retained within the channel of the first locking member by the first spline. The hem bar assembly is adapted to be attached to the shade material in a half-wrap hem bar configuration whereby the shade material is wedged and retained within the channel of the second locking member by the second spline, wrapped about the at least one outer wall of the first hem bar portion, and wedged and retained within the channel of the first locking member by the first spline. The hem bar assembly is adapted to be attached to the shade material in a full-wrap hem bar configuration whereby the shade material is wedged and retained within the channel of the second locking member by the second spline, wrapped about the outer walls of the first and second hem bar portions, and wedged and retained within the channel of the third locking member by the third spline.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

Figure 1:
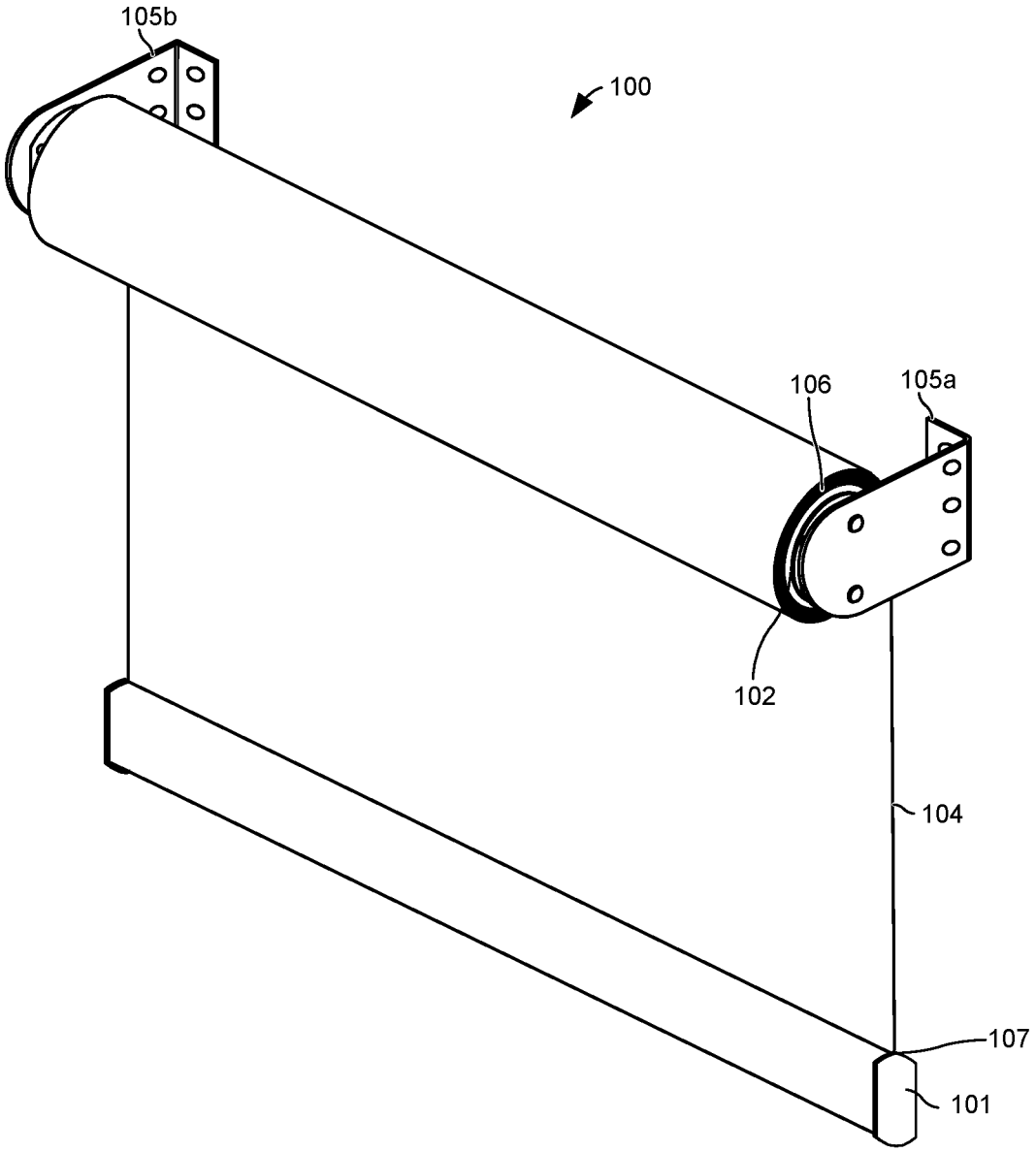

Brief Description of the Several Views of the Drawing

FIG. 1 illustrates a front perspective view of a roller shade comprising a hem bar assembly according to one aspect of the embodiments.

Figure 2A:
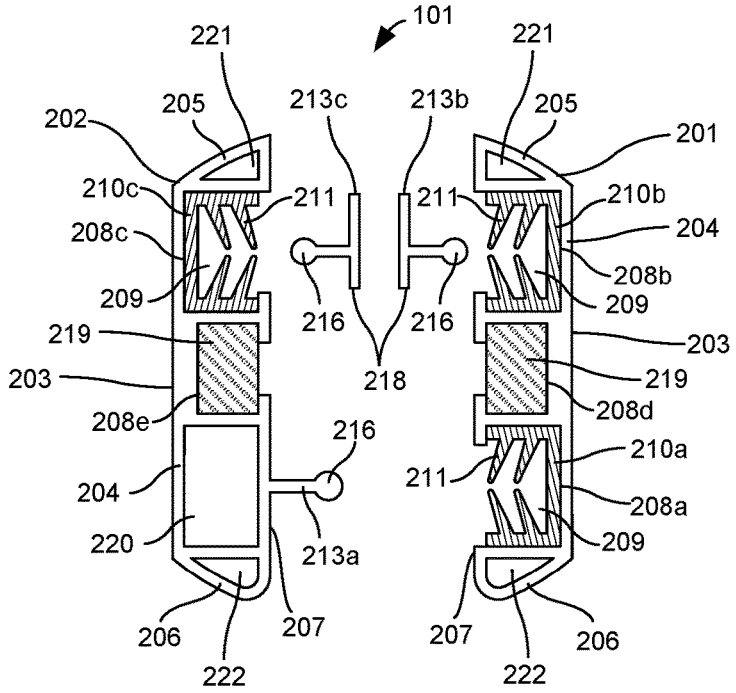

FIG. 2A illustrates a cross sectional view of a hem bar assembly according to one aspect of the embodiments.

Figure 2B:
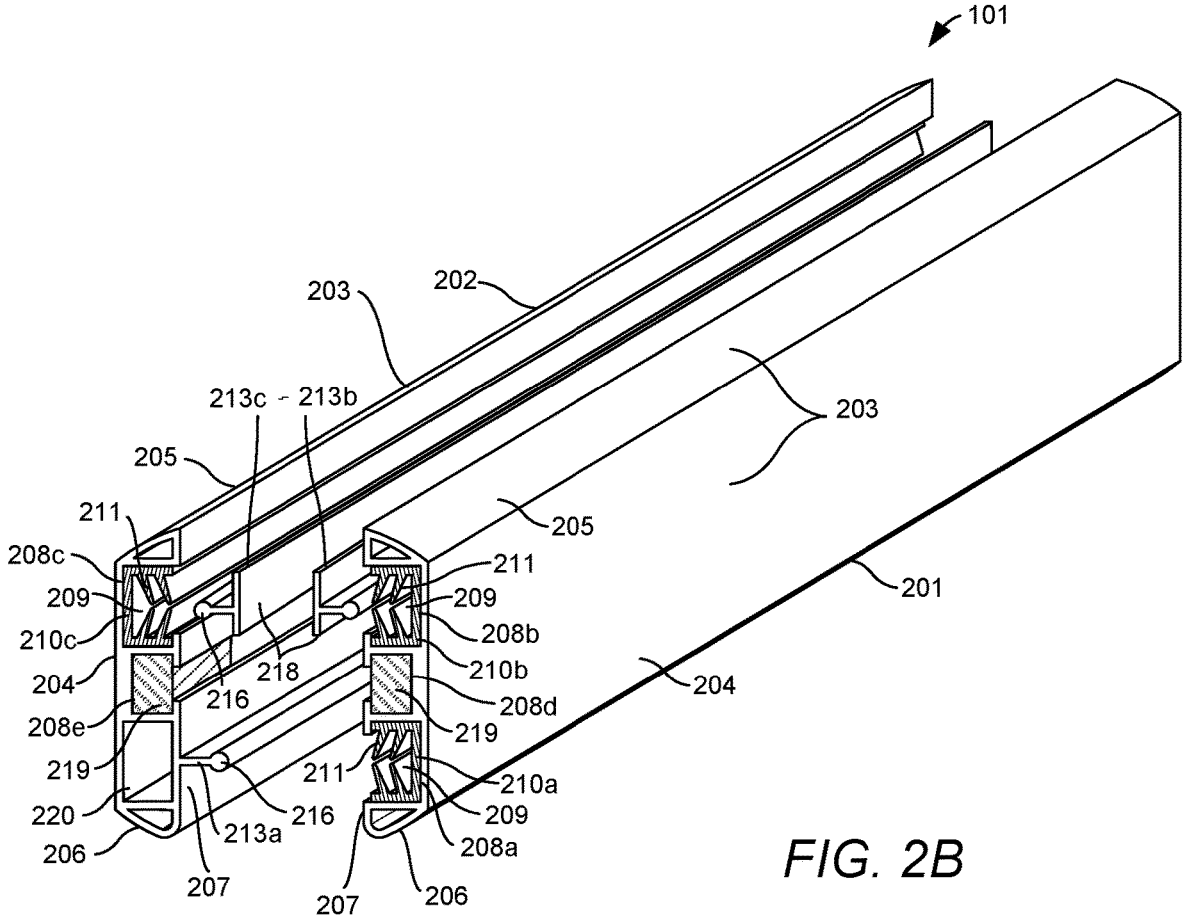

FIG. 2B illustrates an exploded perspective view of the hem bar assembly according to one aspect of the embodiments.

Figure 3A:
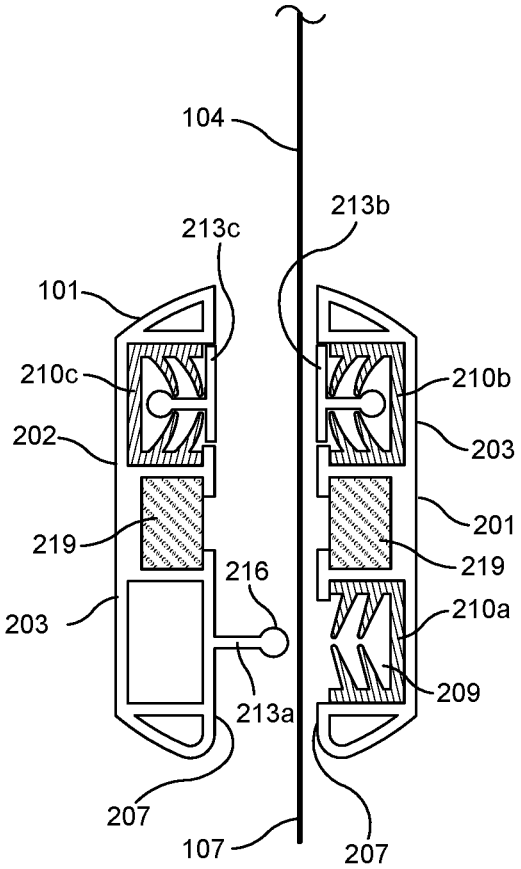
Figure 3B:
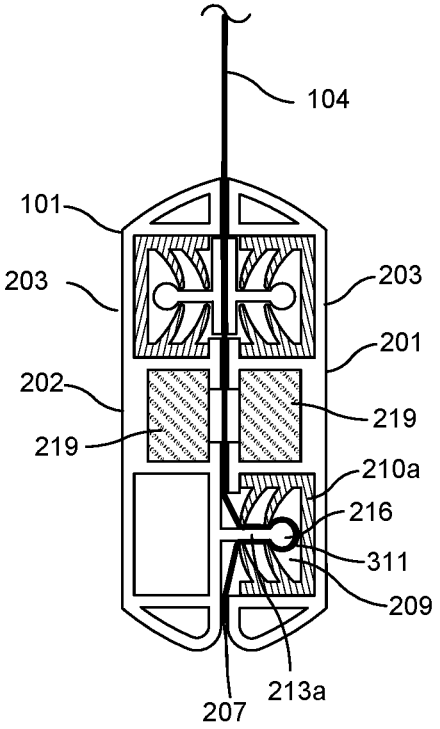
Figure 3C:
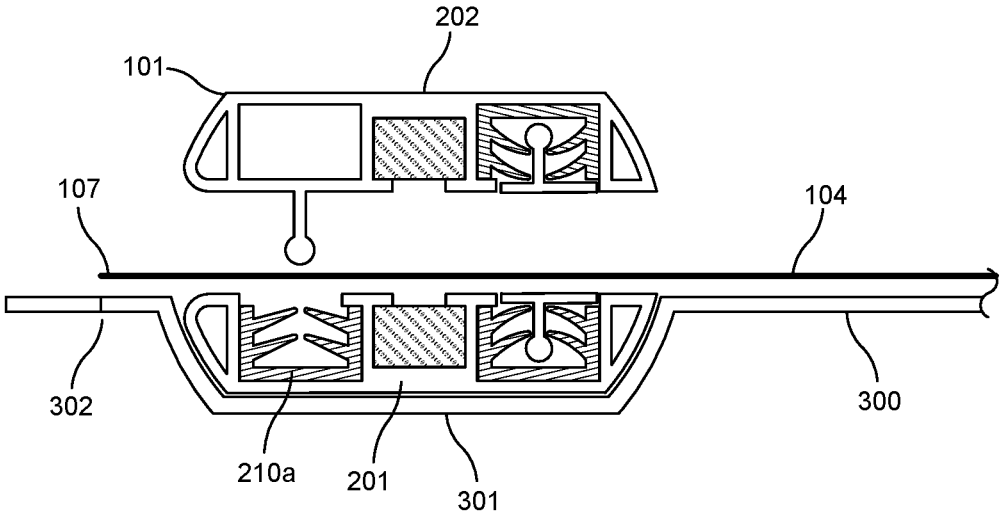

FIGS. 3A-3C illustrate the steps of attaching the hem bar assembly to the shade material in an exposed hem bar style according to one aspect of the embodiments.

FIGS. 4A-4E illustrate the steps of attaching the hem bar assembly to the shade material in a partially wrapped hem bar style according to one aspect of the embodiments.

Figure 5A:
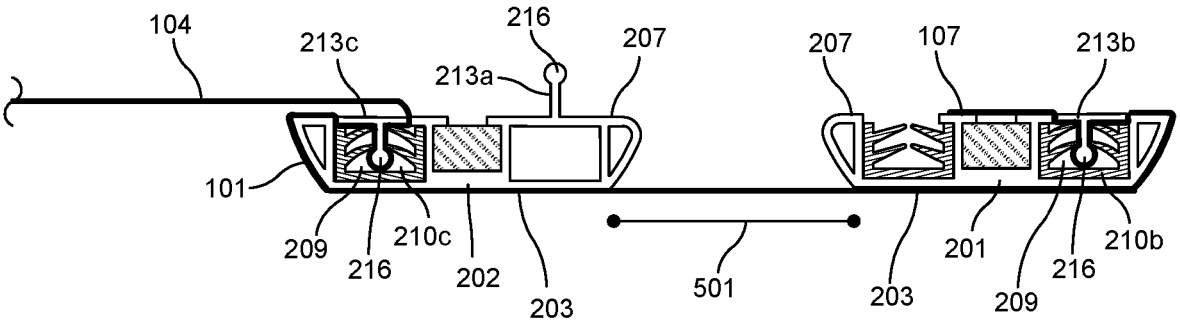
Figure 5B:
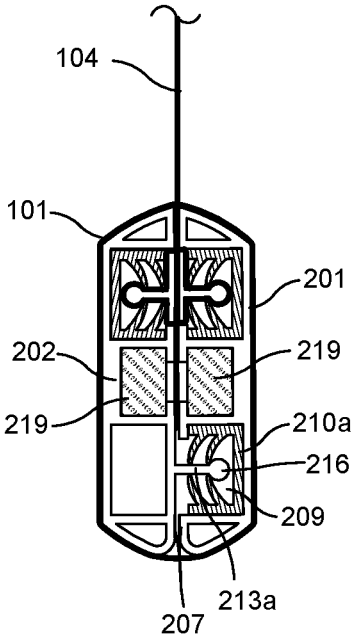

FIGS. 5A-5B illustrate the steps of attaching the hem bar assembly to the shade material in a fully wrapped hem bar style according to one aspect of the embodiments.

FIGS. 6A-6D illustrate a tool for assisting in the method of attaching the hem bar assembly to the shade material in a fully wrapped hem bar style as well as the steps of the method of attaching same according to one aspect of the embodiments.

Figure 7:
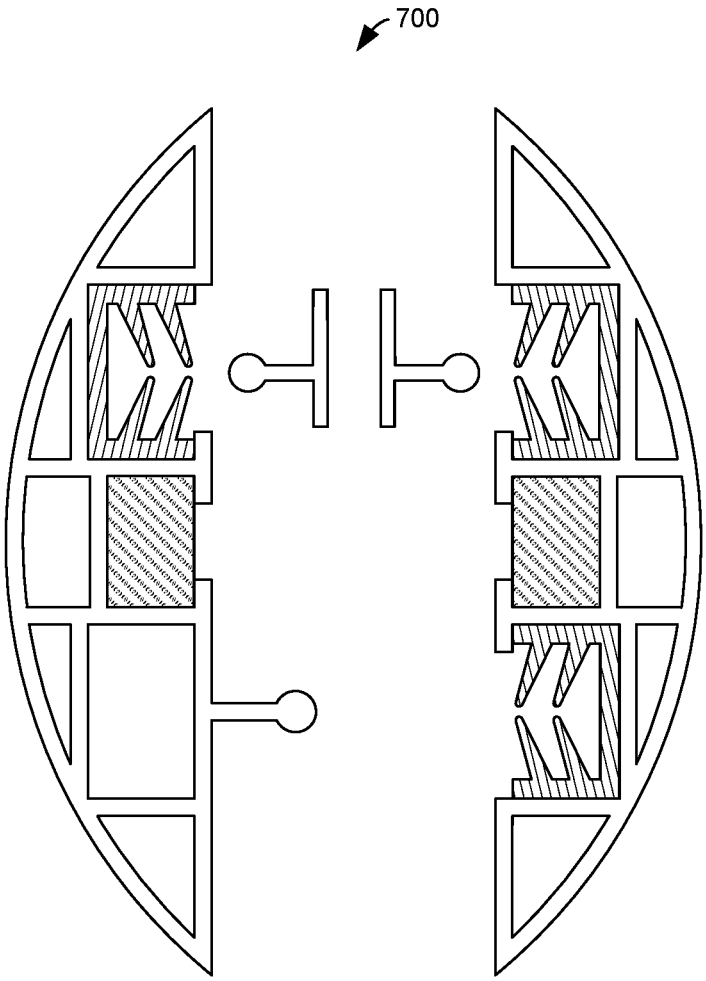

FIG. 7 illustrates a cross sectional view of a hem bar assembly according to another aspect of the embodiments.

Figure 8:
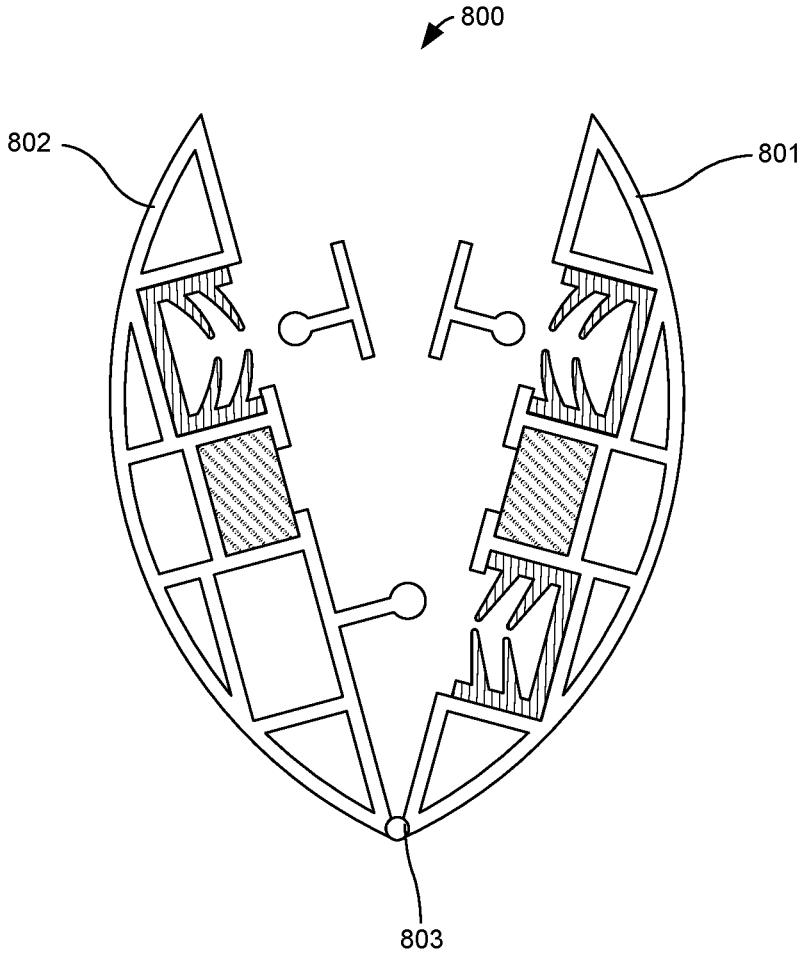

FIG. 8 illustrates a cross sectional view of a hem bar assembly according to yet another aspect of the embodiments.

Figure 9:
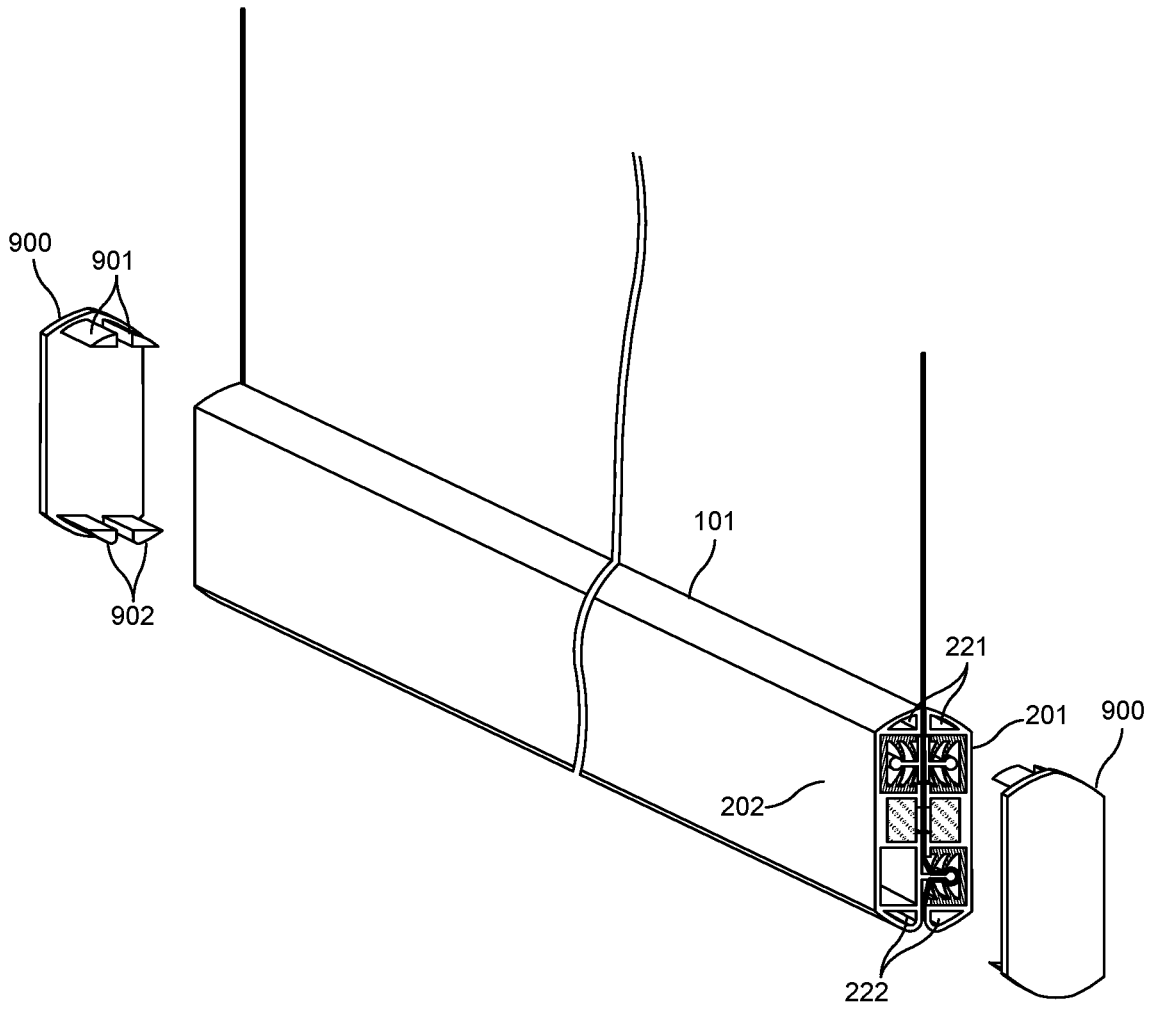

FIG. 9 illustrates a perspective view of a hem bar assembly with end caps according to another aspect of the embodiments.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" on "in an embodiment" in various places throughout the specification is not necessarily referring to the same embodiment. Further, the particular feature, structures, or characteristics may be combined in any suitable manner in one or more embodiments.

LIST OF REFERENCE NUMBERS FO THE ELEMENTS IN THE DRAWINGS IN NUMERICAL ORDER

The following is a list of the major elements in the drawings in numerical order.

100 Roller Shade
101 Hem bar assembly
102 Roller Tube
104 Shade Material
105*a* First Mounting Bracket
105*b* Second Mounting Bracket
106 First End of Shade Material
107 Second End of Shade Material
201 First Hem Bar Portion
202 Second Hem Bar Portion
203 Outer Surface

204 Outer Vertical Wall
205 Top Wall
206 Bottom Wall
207 Inner Vertical Wall
208*a* First Channel
208*b* Second Channel
208*c* Third Channel
208*d* Fourth Channel
208*e* Fifth Channel
209 Locking Member Channel
210*a* First Locking Member
210*b* Second Locking Member
210*c* Third Locking Member
211 Flexible Projections/Flanges
213*a* First Spline
213*b* Second Spline
213*c* Third Spline
216 Longitudinal Male Plug
218 Longitudinal Flat Body
219 Magnets
220 Cavity
221 Top Bores
222 Bottom Bores
300 Tool
301 Cavity
302 Guide
311 Loop
401 Front Face
402 Rear Face
403 Fold
405 Distance
406 Shading Portion
407 Wrapping Portion
501 Distance
600 Tool
601 First Cavity Portion
602 Second Cavity Portion
604 Hinge
605 Guide
607 Fold
700 Hem Bar Assembly
800 Hem Bar Assembly
801 First Hem Bar Portion
802 Second Hem Bar Portion
803 Hinge
900 End Cap(s)
901 Top Projections
902 Bottom Projections

MODE(S) FOR CARRYING OUT THE INVENTION

For 50 years Crestron Electronics, Inc., has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of roller shades, but are not limited thereto, except as may be set forth expressly in the appended claims. While the roller shade is described herein for covering a window, the roller shade may be used to cover other types of architectural openings, such as doors, wall openings, or the like. The embodiments described herein may further be adapted in other types of window or door coverings, such as inverted rollers, Roman shades, Austrian shades, pleated shades, blinds, shutters, skylight shades, garage doors, or the like. The present embodiments provide systems, methods, and modes for a hem bar assembly that simplifies and speeds up the process of securing the hem bar to the shade material without causing damage to the shade material and which can achieve different hem bar styles. Since no welding is needed, the hem bar assembly of the present embodiments further allows the utilization of a broader selection of shade materials without causing flaws in the material. The hem bar assembly of the present embodiments can be also custom cut into any length as required by shade specifications.

Referring to FIG. 1, there is shown a front perspective view of a roller shade 100 comprising a hem bar assembly 101 according to one embodiment. Roller shade 100 generally comprise a roller tube 102, shade material 104, and a hem bar assembly 101. Shade material 104 is connected at its first end 106 to the roller tube 102 and at its second end 107 to the hem bar assembly 101 as further described below. The shade material 104 wraps around the roller tube 102 and is rolled on or unrolled from the roller tube 102 to selectively cover an architectural opening, such as a window. Roller tube 102 is generally cylindrical in shape and longitudinally and laterally extends between and attaches to first and second mounting brackets 105*a* and 105*b*, which in turn are mounted to a window frame or another architectural opening. The roller shade 100 may be rolled down to a closed position or rolled up to an opened position, on in any position therebetween, via a motor, or manually or semi-manually by pulling or tugging on the hem bar assembly 101 or by pulling on a chain or another mechanism (not shown). In various embodiments, the shade material 104 may comprise fabric, plastic, vinyl, or other materials known to those skilled in the art.

Referring to FIGS. 2A and 2B, there is shown a cross sectional view and an exploded perspective view of the hem bar assembly 101, respectively, according to one aspect of the embodiments. According to an embodiment, hem bar assembly 101 comprises a two-part clamp shell configuration having a first hem bar portion 201 and a second hem bar portion 202. First and second portions 201 and 202 may be made of extruded metal material, such as aluminum, although other materials may be utilized such as other types of metal, plastic, composite material, fiber glass, or the like. Each of the first and second portions 201 and 202 comprises an outer vertical wall 204 and an inner vertical wall 207 interconnected at their top ends by an outer top wall 205 and at their bottom ends by an outer bottom wall 206. According to an embodiment, vertical walls 204 are straight while top and bottom walls 205 and 206 are curved, creating a rectangle with rounded sides cross section when the first and second portions 201 and 202 are connected together. However, hem bar assembly 101 may comprise other form factors, such as an oval form factor, a convex form factor hem bar assembly 700 as shown in FIG. 7, a rectangular form factor, or other shapes known in the art. According to an embodiment, the outer configuration of the first and second portions 201 and 202 may be substantially symmetrical so that there is no particular orientation required for assembly. The outer surfaces 203 of the first and second portions 201 and 202 may comprise an outer decorative surface available in a plurality of colors and finishes.

The first hem bar portion 201 may comprise a first channel 208*a* recessed in the inner vertical wall 207 of the first hem bar portion 201. First channel 208*a* is adapted to receive a first locking member 210*a*. First locking member 210*a* may comprise a flexible but resilient material, such as polyvinyl chloride (PVC), polypropylene, or the like. First locking member 210*a* may comprise a shape adapted to fit within first channel 208*a* in the first hem bar portion 201. First locking member 210*a* may comprise a longitudinal channel 209 extending therein having a plurality of integral flexible projections or flanges 211 angularly and inwardly extending therein from its inner walls. First locking member 210*a* may be inserted and slid into the first channel 208*a* through the terminal end of the first hem bar portions 201, or it may be snap fitted therein. The second hem bar portion 202 may in turn comprise a first spline 213*a* laterally and outwardly extending from the inner vertical wall 207 of the second hem bar portion 202. First spline 213*a* may be integrally formed with the second portion 202 or it may be a separate component that attaches to the second portion 202, for example via a channel. First spline 213*a* terminates with a longitudinal male plug 216. First spline 213*a* of the second portion 202 is adapted to be force-fitted within channel 209 of the first locking member 210*a* in the first portion 201 causing the male plug 216 of the first spline 213*a* to be wedged and retained therein by flanges 211. This allows the second portion 202 of the hem bar assembly 101 to be connected and locked with the first portion 201 of the hem bar assembly 101. According to an embodiment, first and second portions 201 and 202 may be disengaged from each other via opposite force.

Each of the first and second hem bar portions 201 and 202 may further comprise second and third channels 208*b-c*, respectively, recessed in their inner vertical wall 207. Each channel 208*b-c* is adapted to receive second and third locking members 210*b-c*, respectively. Second and third locking members 210*b-c* may comprise substantially the same configuration as the first locking member 210*a*, including a longitudinal channel 209 with flexible projections or flanges 211 extending therein. Locking members 210*b-c* are adapted to retain respective second and third splines 213*b-c* therein. Each spline 213*b-c* may comprise a longitudinal flat body 218 with a longitudinal male plug 216 laterally extending from the longitudinal flat body 218. Splines 213*b-c* may comprise a metal extruded material, such as aluminum, or it may comprise other materials know in the art. Splines 213*b-c* are adapted to be force-fitted within the channels 209 of the second and third locking members 210*b-c*, respectively, causing the male plugs 216 of the splines 213*b-c* to be wedged and retained therein by flanges 211. Splines 213*b-c* and locking members 210*b-c*, respectively, are adapted to retain shade material 104 therebetween, as further discussed below, in a way that prevents the shade material 104 from moving.

First and second portions 201 and 202 may further comprise a pair of fourth and fifth channels 208*d* and 208*e*, respectively. Each channel 208*d-e* may retain a single longitudinal magnet or a plurality of magnets 219, such as neodymium magnets, dispersed at substantially equal intervals at predefined positions therein. The number of magnets 219 used and dispersed along channels 208*d-e* may depend on the required size of the hem bar assembly 101, such as for example one magnet per each channel 208*d-e* per foot. Magnets 219 provide additional retention between first and second portions 201 and 202 and to further compress the shade material 104 therebetween as further discussed below.

Second portion 202 (and/or first portion 201) may further comprise a cavity or bore 220 longitudinally extending therethrough into which weighted material, such as steel rods, can be inserted from the terminal end of the hem bar assembly 101 to add additional weight to the hem bar assembly 101. Each of the first and second portions 201 and 202 may further comprise a top bore 221 and a bottom bore 222 such that end caps may be attached to the terminal ends of the hem bar assembly 101 as further discussed below.

FIGS. 3A-3B illustrate the steps of attaching the hem bar assembly 101 to the shade material 104 in an exposed hem bar style, where the outer surfaces 203 of the first and second hem bar portions 201 and 202 are exposed. Referring to FIG. 3A, the shade material 104 is positioned in between the first portion 201 and the second portion 202 such that its second end 107 extends over the first locking member 210*a* and the first spline 213*a*. First and second potions 201 and 202 are then compressed together to force-fit the male plug 216 of first spline 213*a* into channel 209 of the first locking member 210*a* as shown in FIG. 3B. This causes the shade material 104 located therebetween to be inserted into channel 209 and to form a loop 311 surrounding the male plug 216 of the first spline 213*a* such that the shade material 104 is wedged and retained between the first spline 213*a* and the first locking member 210*a*. The rest of the shade material 104 that is located within the hem bar assembly 101 is compressed between the inner walls 207 of the first and second portions 201 and 202 of the hem bar assembly 101. Magnets 219 further compress and retain the shade material 104 between the first and second hem bar portions 201 and 202. According to one embodiment, splines 213*b* and 213*c* together with locking members 210*b* and 210*c* may be left unused in the exposed hem bar style configuration. Alternatively, one or more of the splines 213*b* and/or 213*c* and one or more of the locking members 210*b* and 210*c* may be selectively used to further secure the shade material 104 to hem bar assembly 101. For example, shade material 104 may be first attached between second locking member 210*b* and second spline 213*b*.

Referring to FIG. 3C, according to an embodiment, to ease the process of manufacturing, a tool 300 may be provided, either separately disposed or attached to a shade material cutting or assembly machine. Tool 300 may comprise a cavity 301 sized and shaped to receive the first hem bar portion 201 therein. After the shade material 104 is cut to a requisite length, first hem bar portion 201 (or the second hem bar portion 202) may be recessed in cavity 301 and the shade material 104 may be placed over the first hem bar portion 201. Tool 300 may have a guide 302, such as an indication line, to indicate a predetermined distance by which the second end 107 of the shade material 104 should extend over the first hem bar portion 201 such that there is enough shade material 104 present to be inserted within locking member 210*a*, but that no shade material 104 extends out of the bottom end of the hem bar assembly 101. The second hem bar portion 202 is then pressed onto the first hem bar portion 201 to retain the shade material 104 therebetween as discussed above in greater detail.

Figure 4A:
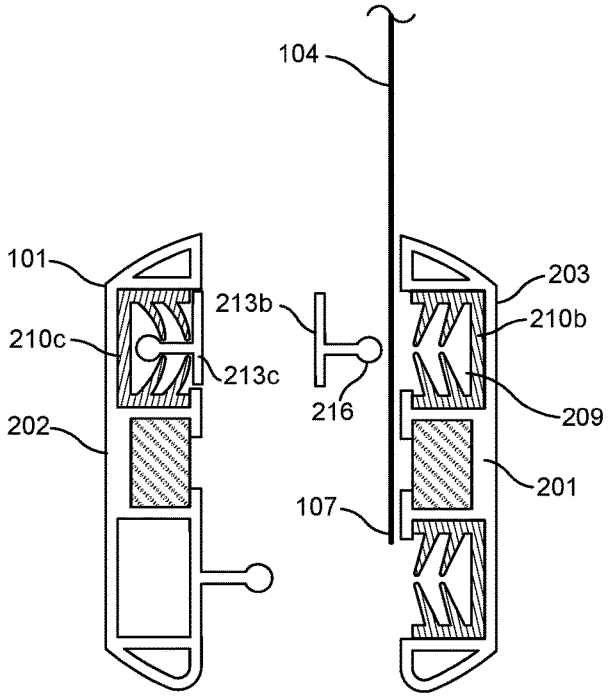
Figure 4B:
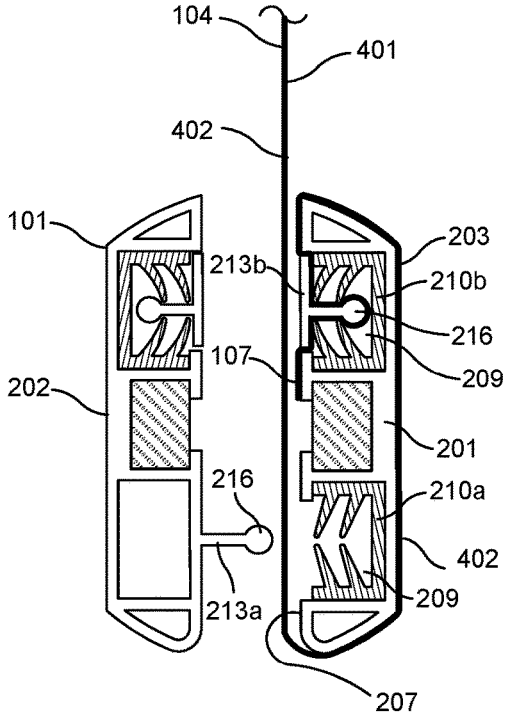
Figure 4C:
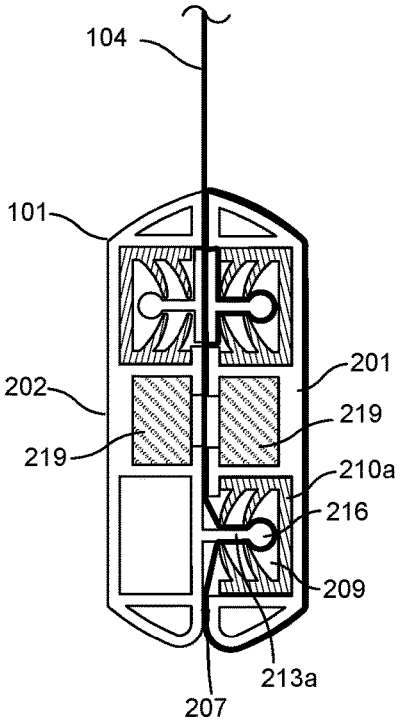

According to one embodiment, FIGS. 4A-4C illustrate the steps of attaching the hem bar assembly to the shade material in a partially wrapped hem bar style where only the front of the hem bar assembly 101 is wrapped with shade material 104. Referring to FIG. 4A, the shade material 104 proximate to its second end 107 is positioned over the second locking member 210*b* of the first hem bar portion 201 and then the second spline 213*b* together with the shade material 104 is force-fitted into channel 209 of the second locking member 210*b* as shown in FIG. 4B. This causes the shade material 104 to be wedged and retained between the second spline 213*b* and the second locking member 210*b*. The shade material 104 is then wrapped around the outer surface 203 of the first hem bar portion 201 and then brought over the inner wall 207 of the first hem bar portion 201 as shown in FIG. 4B. Second hem bar portion 202 is then compressed onto the first hem bar portion 201 to force-fit the male plug 216 of first spline 213*a*, as well as the shade material 104, into channel 209 of the first locking member 210*a* as shown in FIG. 4C. The rest of the shade material 104 that is located within the hem bar assembly 101 is compressed between the inner walls 207 of the first and second portions 201 and 202 of the hem bar assembly 101. Magnets 219 further compress and retain the shade material 104 between the first and second portions 201 and 202. A similar tool as discussed with reference to FIG. 3A may be utilized to retain the first hem bar portion 201 and/or to guide the required length of shade material 104 that is needed for the half wrap configuration. Third spline 213*c* and third locking member 210*c* may be remained unused, although other methods of half wrap are contemplated where they would be utilized.

Figure 4D:
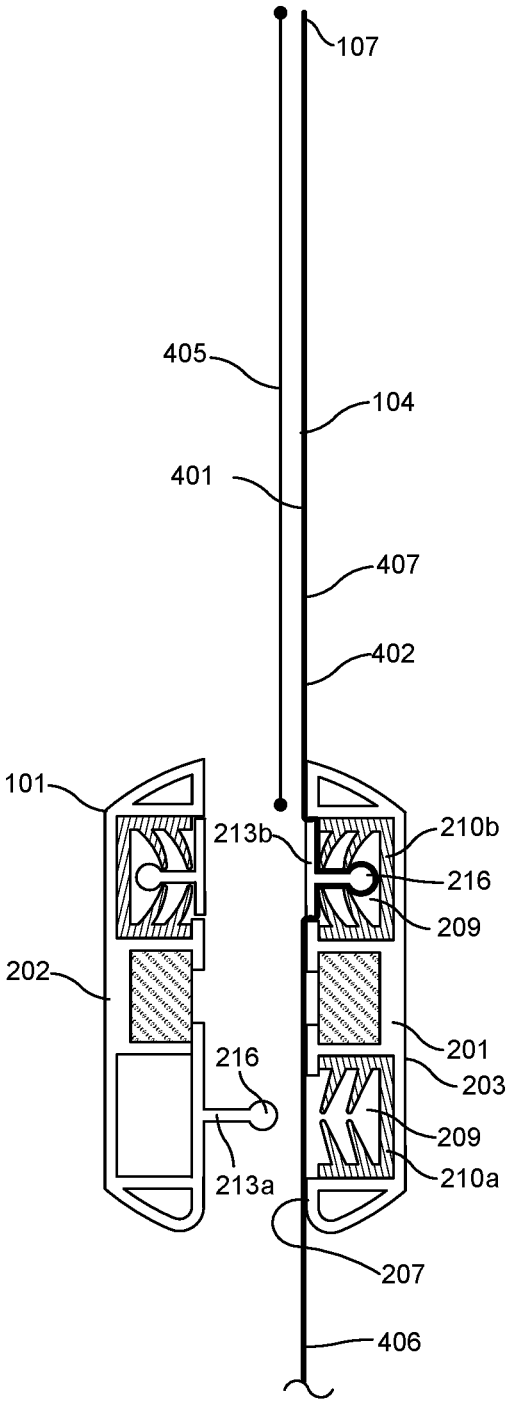
Figure 4E:
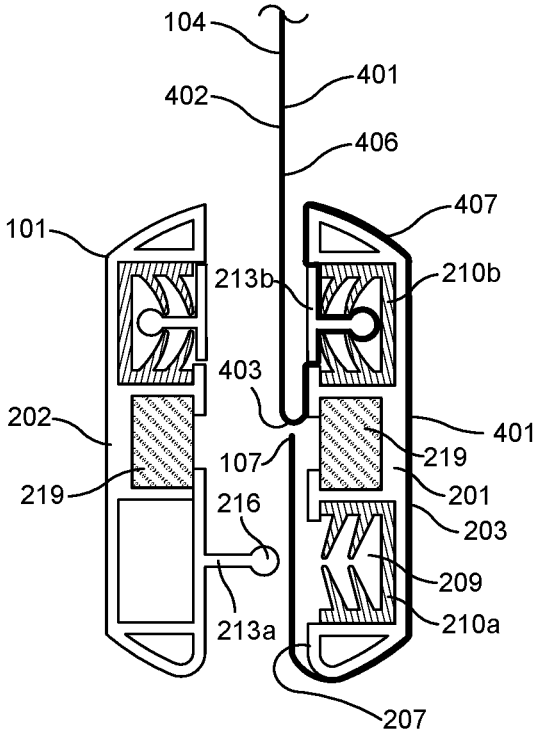

In some shade material designs, the front face 401 of the shade material 104 may be different than the rear face 402 of the shade material 104 (FIG. 4B). For example in light blocking shades, the front face 401 may contain a decorative fabric while the rear face 402 may be colored black to block light. In such cases, the front face 401 of the shade material 104 needs to be facing out when it is wrapped around the first hem bar portion 201 such that it matches with the front face 401 of the shade material 104 hanging between the roller tube 102 and the hem bar assembly 101. Attaching and wrapping the shade material 104 according to the method shown in FIG. 4B, on the other hand, will achieve a different effect, where the rear face 402 of the shade material 104 that is wrapped over the first hem bar portion 201 will be facing out. This may be acceptable in shades where both the faces of the shade material are the same or if such an effect is desired. FIGS. 4D-4E, however, illustrates another way shade material 104 may be half-wrapped over the hem bar assembly 101 to achieve the look where the front or decorative face 401 of the shade material 104 is facing out when it is wrapped around the first hem bar portion 201. First, as shown in FIG. 4D, the shade material 104 may be attached between the second spline 213*b* and the second locking member 210*b* with the rear face 402 facing the inner wall 207 of the first hem bar portion 201. Second end 107 of the shade material 104 needs to extend over the second locking member 210*b* of the first hem bar portion 201 at a sufficient predetermined distance 405 such that there is enough shade material 104 left to wrap over the first hem bar portion 201. The second spline 213*b* is then secured to the second locking member 210*b* over the front face 401 of the shade material 104. The shading portion 406 of the shade material 104 is then folded over the second spline 213*b* forming fold 403 as shown in FIG. 4E. The shade material 104 that remains, or the wrapping portion 407, is then wrapped over outer surface 203 of the first hem bar portion 201 and then brought over the inner wall 207 of the first hem bar portion 201 as shown in FIG. 4E with the front face 401 of the shade material 104 facing outward. Second hem bar portion 202 is then compressed onto the first hem bar portion 201 to force-fit the male plug 216 of first spline 213*a*, as well as the shade material 104, into channel 209 of the first locking member 210*a* (similarly as shown in FIG. 4C). Thereby, the shade material 104 that is located within the hem bar assembly 101 is compressed between the inner walls 207 of the first and second hem bar portions 201 and 202 and further compressed and retained therein via magnets 219. As illustrated in FIG. 4E, the front face 401 of the shade material 104 at both the shading portion 406 and the wrapping portion 407 that is wrapped over the first hem bar portion 201 are facing outward.

FIGS. 5A-5B illustrate the method of attaching the hem bar assembly 101 to the shade material 104 in a fully wrapped hem bar style according to one aspect of the embodiments. The shade material 104 proximate to the second end 107 of the shade material 104 is positioned over the second locking member 210*b* of the first hem bar portion 201 and the second spline 213*b* is force-fitted into channel 209 of the second locking member 210*b* as shown in FIG. 5A. This causes the shade material 104 to be wedged and retained between the second spline 213*b* and the second locking member 210*b*. The shade material 104 is then wrapped around the outer surface 203 of the first hem bar portion 201 and then wrapped around the outer surface 203 of the second hem bar portion 202, while there is enough distance 501 of shade material 104 remaining therebetween to allow the first and second hem bar portions 201 and 202 to be folded together as discussed below. This can be accomplished by, for example, wrapping the shade material 104 over the first hem bar portion 201 and placing the remainder of the shade material 104 and the first hem bar portion 201 on a flat surface. The second hem bar portion 202 can then be placed over the shade material 104 at the predetermined distanced 501 from the first hem bar portion 201. The shade material 104 is then brought over the inner wall 207 of the second hem bar portion 202. The third spline 213*c* is then force-fitted into channel 209 of the third locking member 210*c* causing the shade material 104 to be wedged and retained between the third spline 213*c* and the third locking member 210*c*. First and second hem bar portions 201 and 202 are then brought toward each other and compressed to force-fit the male plug 216 of first spline 213*a* into channel 209 of the first locking member 210*a* as shown in FIG. 5B. The shade material 104 that is located within the hem bar assembly 101 is compressed between the inner walls 207 of the first and second portions 201 and 202 of the hem bar assembly 101, while magnets 219 further compress and retain the shade material 104 therebetween.

Figure 6A:
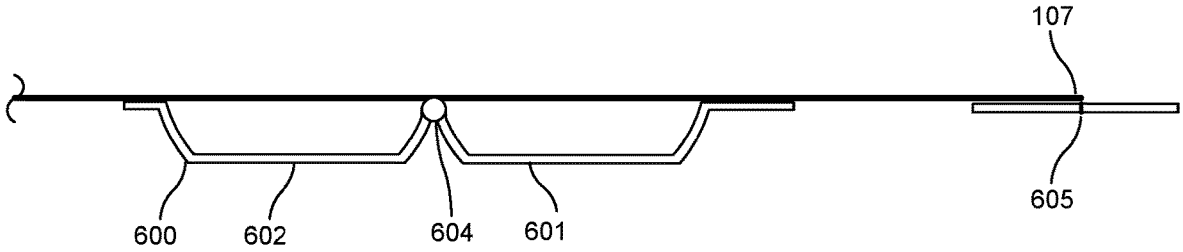
Figure 6B:
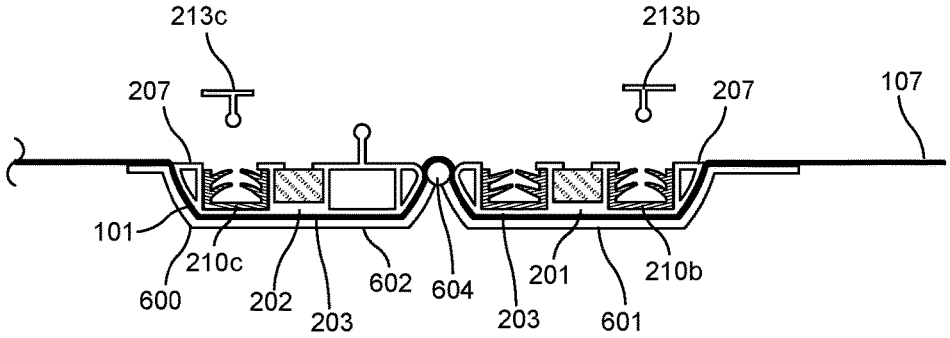
Figure 6C:
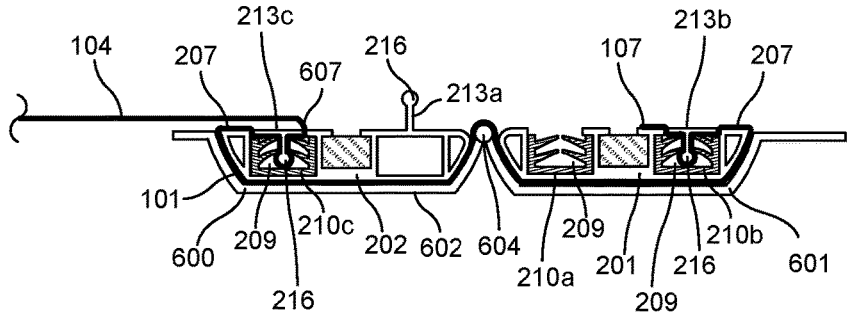
Figure 6D:
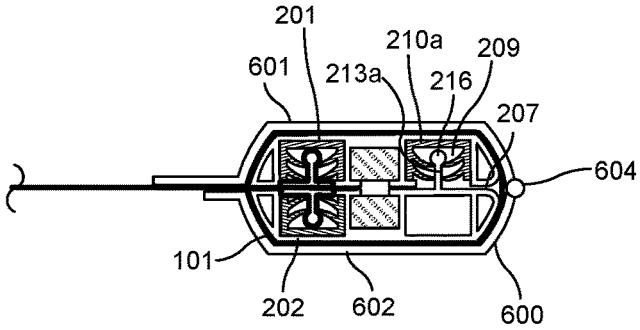

According to an embodiment, referring to FIGS. 6A-6D, to ease the process of manufacturing, a tool 600 may be provided, either independent of or part of a shade material cutting machine or another assembly machine. Tool 600 may comprise a first cavity portion 601 and a second cavity portion 602 sized and shaped to receive the first hem bar portion 201 and the second hem bar portion 202, respectively, therein. The first cavity portion 601 may be connected to the second cavity portion 602 via a hinge 604. As shown in FIG. 6A, after the shade material 104 is cut to requisite length, the shade material 104 may be placed over the first and second cavity portions 601 and 602. The assembly machine or tool 600 may have a guide 605, such as an indication line, indicating a predetermined distance by which the shade material 104 needs to extend over the first cavity 601 such as there is enough shade material 104 present to be wrapped over the hem bar assembly 101. First and second hem bar portions 201 and 202 are then recessed into the first and second cavities 601 and 602, respectively, compressing the shade material 104 therebetween as shown in FIG. 6B. The second end 107 of the shade material 104 is then folded over the inner wall 207 and thereby over the second locking member 210*b* of the first hem bar portion 201 as shown in FIG. 6C. The second spline 213*b* is then force-fitted into channel 209 of the second locking member 210*b*, causing the shade material 104 to be wedged and retained between the second spline 213*b* and the second locking member 210*b*. The shade material 104 proximate to the shading portion is then folded over the inner wall 207 and thereby over the third locking member 210*c* of the second hem bar portion 202. The third spline 213*c* is then force-fitted into channel 209 of the third locking member 210*c* causing the shade material 104 to be wedged and retained between the third spline 213*c* and the third locking member 210*c*. The shade material 104 is then folded back over the third spline 213*c* forming a fold 607 shown in FIG. 6C such that it exits from the top of the second hem bar portion 202. The first cavity portion 601 of tool 600 is then rotated via hinge 604 over the second cavity portion 602 (or vice verse) to bring the first hem bar portion 201 over the second hem bar portion 202 and compress and lock them as shown in FIG. 6D and as discussed above with reference to FIG. 5B.

FIG. 8 illustrates a cross sectional view of a hem bar assembly 800 according to another aspect of the embodiments. Hem bar assembly 800 may comprise a first hem bar portion 801 and a second hem bar portion 802 with substantially same configuration as first and second hem bar portions 201 and 202 discussed above. First hem bar portion 801 and second hem bar portion 802 may be attached together with a hinge 803 such that they can open and clamp together with the assistance of the hinge 803. According to an embodiment, hinge 803 may be a disengaging hinge such that the first hem bar portion 801 may be disengaged from the second hem bar portion 802. The hem bar assembly 800 simplifies the process of achieving an exposed hem bar style and a fully wrapped hem bar style in a similar manner as discussed above with reference to FIGS. 3A-3B and 5A-5B.

Referring to FIG. 9, hem bar assembly 101 may further be provided with end caps 900, which may comprise similar shape and profile as the hem bar assembly 101 such that end caps 900 cover the terminal ends of the hem bar assembly 101. In addition to providing a decorative finish to the ends of the hem bar assembly 101, end caps 900 may further assist in retaining the first and second hem bar portions 201 and 202 together. Each hem bar portion 201 and 202 may comprise a top bore 221 and a bottom bore 222 longitudinally extending therethrough. Each end cap 900, in turn, may comprise a pair of top projections 901 and a pair of bottom projections 902 extending from the inner surface of the end cap 900. Top projections 901 and bottom projections 902 are sized and shaped to fit within the top bores 221 and bottom bores 221 of the first and second hem bar portions 201 and 202, respectively. During assembly, after the first and second hem bar portions 201 and 202 are clamped together, end caps 900 can be secured to the terminal ends of the hem bar assembly 101 by inserting the projections 901 and 902 of end caps 900 through bores 221 and 222, respectively. Projections 901 and 902 and bores 221 and 222 may further comprise a locking mechanism as known in the art (e.g., hooks/arms and shoulders) such that end caps 900 can snap-fit into the hem bar assembly 100. Alternatively, projections 901 and 902 may friction fit into bores 221 and 222. Accordingly, end caps 900 provide a four point retention to maintain first and second hem bar portions 201 and 202 together, although a two point of retention may also be used (such as a single bore per each hem bar portion 201 and 202 and two projections on each end cap 900).

INDUSTRIAL APPLICABILITY

To solve the aforementioned problems, the aspects of the embodiments are directed towards a hem bar assembly that simplifies the process of securing the hem bar to the shade material without causing damage to the shade material and which can achieve different hem bar styles. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments. In various embodiments, the roller shade described herein may be used to cover a window, a door, a wall opening, or the like. In addition, the embodiments described herein may be adapted in other types of window or door coverings, such as inverted rollers, Roman shades, Austrian shades, pleated shades, blinds, shutters, skylight shades, garage doors, or the like.

What is claimed is:

1. A hem bar assembly adapted to secure to a shade material of a roller shade comprising:

a first longitudinal hem bar portion comprising an outer wall and an inner wall;

a first locking member recessed in the inner wall of the first hem bar portion and comprising a channel, wherein the first locking member is made from a different material than the first hem bar portion;

a second longitudinal hem bar portion comprising an outer wall and an inner wall; and a first longitudinal spline comprising a plug;

wherein the first hem bar portion is adapted to attach to the second hem bar portion and retain the shade material therebetween; and wherein the plug of the first spline is adapted to be force fitted and thereby retained within the channel of the first locking member.

2. The hem bar assembly of claim 1, wherein the first locking member comprises a flexible material.

3. The hem bar assembly of claim 1, wherein the shade material is adapted to be wedged and retained within the channel of the first locking member by the first spline.

4. The hem bar assembly of claim 3, wherein when the shade material is attached to the hem bar assembly, the outer walls of the first and second hem bar portions remain exposed.

5. The hem bar assembly of claim 1, wherein the first spline laterally and outwardly extends from the inner wall of the second hem bar portion.

6. The hem bar assembly of claim 5, wherein the plug of the first spline and the channel of the first locking member interact to attach the first hem bar portion to the second hem bar portion.

7. The hem bar assembly of claim 1 further comprising:

a second locking member recessed in the inner wall of the first hem bar portion and comprising a channel; and a second longitudinal spline comprising a plug adapted to be force fitted and thereby retained within the channel of the second locking member in the first hem bar portion.

8. The hem bar assembly of claim 7, wherein the shade material is adapted to be wedged and retained within the channel of the second locking member by the second spline.

9. The hem bar assembly of claim 8, wherein the shade material is further adapted to be wedged and retained within the channel of the first locking member by the first spline.

10. The hem bar assembly of claim 9, wherein the shade material is adapted to be wrapped over the outer wall of the first hem bar portion.

11. The hem bar assembly of claim 1 further comprising:

a third longitudinal locking member recessed in the inner wall of the second hem bar portion and comprising a channel; and a third longitudinal spline comprising a plug adapted to be force fitted and thereby retained within the channel of the third locking member in the second hem bar portion.

12. The hem bar assembly of claim 11, wherein the shade material is adapted to be wedged and retained within the channel of the first locking member by the first spline, and wherein the shade material is adapted to be wedged and retained within the channel of the third locking member by the third spline.

13. The hem bar assembly of claim 12, wherein the shade material is adapted to be wrapped over the outer walls of the first and second hem bar portions.

14. The hem bar assembly of claim 1, wherein the first and second hem bar portions further comprise a pair of magnets recessed in their respective inner surfaces, wherein the pair of magnets provide additional retention between the first and second hem bar portions.

15. The hem bar assembly of claim 1, wherein at least one of the first and second hem bar portions comprises a bore longitudinally extending therethrough adapted to receive weighted material therein.

16. The hem bar assembly of claim 1, wherein each of the first hem bar portion and the second hem bar portion comprises at least one bore extending through terminal ends thereof, wherein the hem bar assembly further comprises a pair of end caps each comprising at least two projections adapted to fit within the bores in the first and second hem bar portions to provide additional retention between the first and second hem bar portions.

17. The hem bar assembly of claim 1, wherein the channel of the first locking member comprises a plurality of flanges inwardly extending therefrom, and wherein the plug of the first spline is adapted to be force fitted and thereby retained within the channel of the first locking member by the plurality of flanges.

18. A hem bar assembly adapted to secure to a shade material of a roller shade comprising:

a first longitudinal hem bar portion comprising an outer wall, an inner wall substantially parallel to the out wall, and a first locking member recessed in the inner wall of the first hem bar portion, wherein the first locking member comprises a channel and a plurality of flanges inwardly extending therefrom;

a second longitudinal hem bar portion comprising an outer wall and an inner wall; and a first longitudinal spline comprising a plug;

wherein the first hem bar portion is adapted to attach to the second hem bar portion and retain the shade material therebetween; and wherein the plug of the first spline is adapted to be force fitted and thereby retained within the channel of the first locking member by the plurality of flanges.

19. A hem bar assembly adapted to secure to a shade material of a roller shade comprising:

a first longitudinal hem bar portion comprising an outer wall, an inner wall substantially parallel to the out wall, and a first locking member and a second locking member recessed in the inner wall of the first hem bar portion and each comprising a channel;

a second longitudinal hem bar portion comprising an outer wall, an inner wall, and a first longitudinal spline laterally and outwardly extending from the inner wall of the second hem bar portion and terminating with a plug;

a second longitudinal spline comprising a plug;

wherein the plug of the first spline is adapted to be force fitted and thereby retained within the channel of the first locking member to attach the first hem bar portion to the second hem bar portion;

wherein the shade material is adapted to be retained between the first hem bar portion and the second hem bar portion; and wherein the plug of the second spline is adapted to be force fitted and thereby retained within the channel of the second locking member in the first hem bar portion.

* * * * *